US010785860B2

(12) United States Patent
Park et al.

(10) Patent No.: US 10,785,860 B2
(45) Date of Patent: Sep. 22, 2020

(54) DOUBLE-FREQUENCY POWER-DRIVEN INDUCTIVELY COUPLED PLASMA TORCH, AND APPARATUS FOR GENERATING NANOPARTICLE USING SAME

(71) Applicants: KOREA INSTITUTE OF MACHINERY & MATERIALS, Daejeon (KR); INDUSTRIAL COOPERATION FOUNDATION OF CHONBUK NATIONAL UNIVERSITY, Jeonju-si (KR)

(72) Inventors: Hee-Chang Park, Daejeon (KR); Dong-Won Yun, Daejeon (KR); Jun-Ho Seo, Daejeon (KR); Junseok Nam, Daejeon (KR); Mi-Yeon Lee, Daejeon (KR); Jeong-Soo Kim, Daejeon (KR)

(73) Assignees: KOREA INSTITUTE OF MACHINERY & MATERIALS, Daejeon (KR); INDUSTRIAL COOPERATION FOUNDATION OF CHONBUK NATIONAL UNIVERSITY, Jeonju-si (KR)

( * ) Notice: Subject to any disclaimer, the term of this patent is extended or adjusted under 35 U.S.C. 154(b) by 284 days.

(21) Appl. No.: 15/739,418

(22) PCT Filed: Jun. 23, 2016

(86) PCT No.: PCT/KR2016/006719

§ 371 (c)(1),
(2) Date: Dec. 22, 2017

(87) PCT Pub. No.: WO2016/209007

PCT Pub. Date: Dec. 29, 2016

(65) Prior Publication Data

US 2018/0192504 A1 Jul. 5, 2018

(30) Foreign Application Priority Data

Jun. 25, 2015 (KR) ..... 10-2015-0090286

(51) Int. Cl.
*H05H 1/30* (2006.01)
*B22F 9/14* (2006.01)
(Continued)

(52) U.S. Cl.
CPC ..... *H05H 1/30* (2013.01); *B22F 9/14* (2013.01); *H05H 1/36* (2013.01); *H05H 1/42* (2013.01); *H05H 2001/4652* (2013.01)

(58) Field of Classification Search
CPC ... H05H 1/30; H05H 1/36; H05H 1/42; B22F 9/14
(Continued)

(56) References Cited

U.S. PATENT DOCUMENTS 5,611,947 A * 3/1997 Vavruska ..... H05H 1/30 110/238
6,236,014 B1 * 5/2001 Ulrich ..... B23K 10/006 219/121.45
(Continued)

FOREIGN PATENT DOCUMENTS

JP 11-251088 9/1999
KR 10-2010-0025699 3/2010
(Continued)

*Primary Examiner* — Vishal Pancholi
(74) *Attorney, Agent, or Firm* — Lex IP Meister, PLLC

(57) ABSTRACT

A dual frequency power-driven inductively coupled plasma torch according to an exemplary embodiment of the present invention includes: a hollow confinement tube provided with a space in which thermal plasma is formed; an induction coil that surrounds the confinement tube; and a power supply source that supplies power to the induction coil, wherein the power supply source may supply at least two powers having different frequencies to the induction coil.

14 Claims, 10 Drawing Sheets

(51) Int. Cl.
*H05H 1/36* (2006.01)
*H05H 1/42* (2006.01)
*H05H 1/46* (2006.01)

(58) Field of Classification Search
USPC ..... 219/121.54
See application file for complete search history.

(56) References Cited

U.S. PATENT DOCUMENTS

| | | | | |
|---|---|---|---|---|
| 6,695,035 | B2 * | 2/2004 | Kimura | B22D 11/001 164/507 |
| 7,682,472 | B2 * | 3/2010 | Kaneko | B22D 11/086 148/538 |
| 8,769,993 | B2 * | 7/2014 | Ebi | C01B 33/02 65/356 |
| 2012/0230902 | A1 * | 9/2012 | Kaneko | B22D 11/115 423/348 |

FOREIGN PATENT DOCUMENTS

| | | |
|---|---|---|
| KR | 10-2010-0059596 | 6/2010 |
| KR | 10-2011-0087598 | 8/2011 |
| KR | 10-2011-0129299 | * 12/2011 |
| KR | 10-2012-0101046 | 9/2012 |

* cited by examiner

DOUBLE-FREQUENCY POWER-DRIVEN INDUCTIVELY COUPLED PLASMA TORCH, AND APPARATUS FOR GENERATING NANOPARTICLE USING SAME

TECHNICAL FIELD

The present invention relates to a high-frequency power-driven plasma torch.

BACKGROUND ART

Plasma that is industrially used may be divided into low-temperature plasma and thermal plasma, and the present invention relates to a thermal plasma technique of forming a high-temperature plasma flame. The low-temperature plasma is formed at a temperature range of tens of degrees Celsius to hundreds of degrees Celsius and a pressure range of hundreds of Torr, and is mainly used in semiconductor manufacturing, while thermal plasma is formed at a temperature range of thousands of degrees Celsius to tens of thousands of degrees Celsius and atmospheric pressure, and is widely used in incineration, metal cutting, and the like.

The thermal plasma is used in manufacturing of metal nanoparticles, and FIG. 1 illustrates an inductively coupled plasma torch for forming metal nanoparticles. An induction coil 105 is wound around a cylindrical confinement tube 108, and the induction coil 105 is connected to a power supply 101 to receive an AC voltage from the power supply 101. Materials to be processed, that is, precursors of nano-metal particles, are introduced into the confinement tube 108 together with a carrier gas through an injection probe 106, and they are instantaneously evaporated by thermal plasma 120 formed in the confinement tube 108 to be converted into nano-metal particles. The injection probe 106 is exposed to an ultra-high temperature state of the thermal plasma, thus it may be cooled by a water-cooling method. A source gas of the thermal plasma and a sheath gas may be introduced together around the injection probe 106.

An operation principle of a high-frequency inductively coupled plasma torch will be specifically described with reference to FIG. 2: (1) A high-frequency current $I_0$ is applied to an induction coil; (2) The high-frequency current $I_0$ induces a time-varying magnetic field B in the induction coil according to Ampere's law; (3) The time-varying magnetic field B induces an electric field $E_\theta$ in a rotational direction in the confinement tube according to Faraday's law such that ions and electrons in the confinement tube are accelerated to collide with surrounding gases to continuously generate ionization, thus an eddy current $I_p$ is generated; and (4) Energy and plasma gas are constantly supplied so that gases passing through the confinement tube are changed to an ionized thermal fluid state by Joule heat generated by the eddy current $I_p$.

Due to such a plasma generation and maintenance principle, the high-frequency inductively coupled plasma torch may transmit energy in a non-contact manner to a fluid passing through the confinement tube, thus it is possible to provide an ultra-high temperature and high-enthalpy heat source required for processes such as nano-powder synthesis, coal gasification, and gas decomposition, as well as a reforming process, through melting and vaporizing of solid-phase precursors without contamination by electrode materials or without replacement of consumable parts.

On the other hand, the electrical energy supplied to the ionized heat fluid passing through the confinement tube is transmitted through the time-varying electromagnetic field generated from the induction coil according to the transformer principle and the Joule heat generated by the eddy current induced by the time-varying electromagnetic field. Therefore, it is necessary to optimize primary design parameters of the high-frequency power source and the torch such as a frequency, a number of coil windings, a diameter of the confinement tube, and the like in order to efficiently transmit the high-frequency power required for each application purpose. For example, assuming that the high-frequency inductively coupled plasma is a circular material made of a metal, it is known that coupling efficiency is highest when a diameter L of the confinement tube satisfies a frequency f in Equation 1 in consideration of a skin effect.

$$D[\text{mm}] \geq 3.5 \times \frac{1}{\sqrt{\pi f \mu \sigma}}[\text{mm}] \quad \text{(Equation 1)}$$

In Equation 1, μ and σ are permeability and electrical conductivity of the thermal plasma flame, respectively. That is, the driving frequency representing the optimum efficiency may be determined according to the diameter of the confinement tube. Considering that the electrical conductivity σ of most gases, such as argon and nitrogen, is 10 S/cm at a thermal plasma temperature of 8000 K, when the torch is designed so that the diameter L of the confinement tube is 40 mm, a limit frequency of the frequency f is approximately 4 MHz.

Therefore, in a case of a small torch with a small diameter, it is necessary to further increase the frequency according to the above equation to be fit for a reduced torch inner diameter, and conversely, it may be preferable to select a low frequency to make a large torch or a large area plasma by increasing the torch inner diameter. For example, when a large diameter torch is made so that the diameter L of the confinement tube is 100 mm or more, a frequency of about 0.5 MHz may provide the optimum efficiency, and in order for the diameter L to be 200 mm or more, it is necessary to maintain inductively coupling efficiency highly by using a frequency of a 50 KHz band.

FIG. 3 illustrates electric field distribution from a central axis of the confinement tube 108 to a radius thereof when the diameter L of the confinement tube 108 is 40 mm and power of driving frequencies of 6 MHz and 1 MHz is supplied. In FIG. 3, since r is a distance from a center of the confinement tube 108, r=0 mm corresponds to a center of the confinement tube 108, and r=20 mm corresponds to an inner circumferential surface of the confinement tube 108. The electromagnetic field distribution shown in FIG. 3 indicates the skin effect in which a penetration depth of the time-varying electromagnetic field according to the applied high frequency is deeper as the frequency decreases, and it indicates that Joule heat intensively generated in a skin depth also moves from the confinement tube of the torch to the central axis of the torch as the frequency decreases according to change of the penetration depth. As a result, as the frequency decreases, the highest temperature region of the generated plasma becomes closer to the central axis of the torch, which results in an appearance of a diameter of the plasma being tapered.

In summary, it is known that it is preferable to reduce a frequency of driving power in consideration of efficiency when a conventional large diameter and large power plasma torch is designed. However, the conventional low-frequency and large diameter plasma torch designed in this manner has a spatial advantage of mass-injection of materials to be processed and an advantage of high output, but since a diameter of the generated plasma region itself is reduced due to the low frequency, its plasma flame does not fill the torch and becomes relatively thin. Therefore, the plasma flame is easily shaken by the sheath gas for protecting the confinement tube therein and becomes unstable, thus quality of the generated plasma may deteriorate.

In contrast, in a case of the high-frequency and small diameter plasma torch, since the skin effect is concentrated on the confinement tube of the torch, Joule heat generation distribution in a skin depth is also formed closer to the confinement tube than the central axis of the torch, thus a so-called maximum off-axis temperature distribution in which the highest temperature in the plasma deviates from the central axis and is concentrated toward the confinement tube, is formed. Therefore, since the torch may generate the plasma flame to be relatively and fully filled in the torch, it is advantageous in forming stable and high-quality plasma with high enthalpy, but since the heat loss toward the confinement tube increases, the thermal efficiency of the torch deteriorates, and additionally, when the diameter of the torch is reduced, it is difficult to inject a large amount of materials to be processed along the central axis of the plasma, and there is a limit in increasing the output thereof.

DISCLOSURE

Technical Problem

The present invention has been made in an effort to provide an inductively coupled plasma torch that may allow thermal plasma to have a relatively uniform temperature distribution in a confinement tube and to be formed over a large volume in the confinement tube.

Technical Solution

An exemplary embodiment of the present invention provides a dual frequency power-driven inductively coupled plasma torch, including: a hollow confinement tube provided with a space in which thermal plasma is formed; an induction coil that surrounds the confinement tube; and a power supply source that supplies power to the induction coil, wherein the power supply source may supply at least two powers having different frequencies to the induction coil.

The at least two powers having different frequencies may be supplied to the induction coil in a simultaneous dual frequency (SDF) manner, and the at least two powers having different frequencies may be implemented by two separate power sources and two inverters or by one power source and two inverters connected in parallel to the one power source.

The at least two powers having different frequencies may be time sharing dual frequency powers that are time-shared and alternately supplied to the induction coil.

A low-frequency power of the at least two powers having different frequencies may have a frequency of 0.05-0.5 MHz, and a high-frequency power thereof may have a frequency of 1-20 MHz. The dual frequency power-driven inductively coupled plasma torch may be suitable for a confinement tube of a large diameter of 80 mm or more and a large plasma torch using high power of 50 kW or more. The dual frequency power-driven inductively coupled plasma torch may further include an injection probe that introduces nano-metal particle precursors into the confinement tube.

Another embodiment of the present invention provides an apparatus for generating nanoparticles, including: a device that supplies nanoparticle precursors; and the aforementioned dual frequency power-driven inductively coupled plasma torch that receives and evaporates the nanoparticle precursors from the device to form nanoparticles. The nanoparticle precursors may be introduced into the confinement tube from the device through an injection probe, and the nanoparticle precursors may be one or more materials selected from a metal, a metal oxide, and a ceramic.

The nanoparticle precursors may be aluminum, titanium, zirconia ($ZrO_2$), iron, aluminum oxide ($Al_2O_3$), or stainless steel.

Advantageous Effects

According to the embodiments of the present invention, by applying two or more powers having different frequencies and outputs instead of a single frequency power to the induction coil of the inductively coupled plasma torch, it is possible to obtain technical effects that may not be obtained when the single frequency power is used in the prior art, for example, a thermal plasma flame of an ultra-high temperature (3000 K or more) of a relatively wide and large volume in a high output and large diameter torch.

Particularly, according to the embodiments of the present invention, by adjusting the output and the ratio of the low-frequency power and the high-frequency power, it is possible to finely control the electromagnetic field distribution and the temperature distribution inside the torch, thereby providing optimal thermal plasma output, high temperature region, and residence time.

According to the embodiments of the present invention, since the high efficiency and low-frequency power source using semiconductor power device technology may be inexpensively used as a high output power source, it is possible to overcome the technical limit of the prior art which relies on the expensive and low efficiency vacuum tube type of high-frequency power source and to provide an energy-saving and cost-saving type of high frequency plasma torch.

DESCRIPTION OF SYMBOLS

Figure 1:
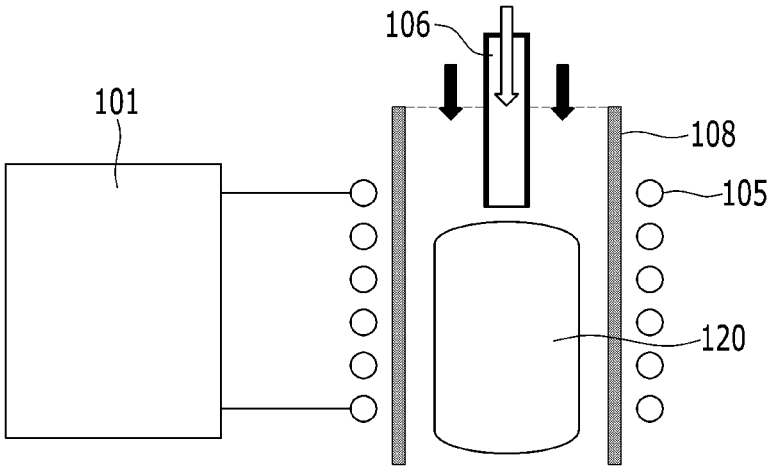
FIG. 1 illustrates a schematic view of a conventional inductively coupled plasma torch.
Figure 2:
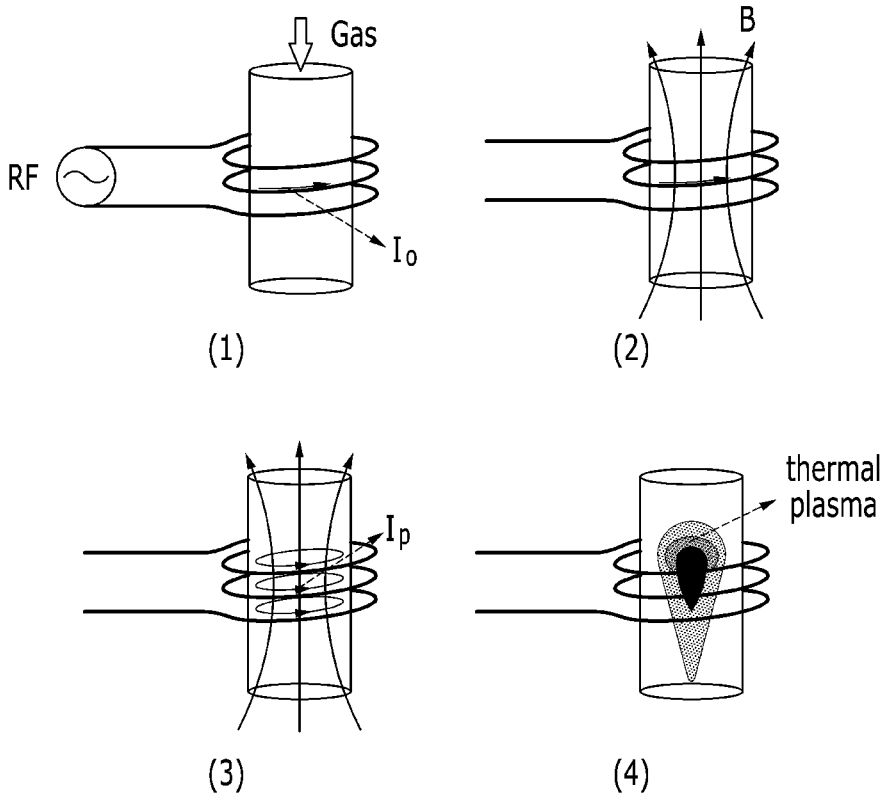
FIG. 2 illustrates an operational principle of an inductively coupled plasma torch.
Figure 3:
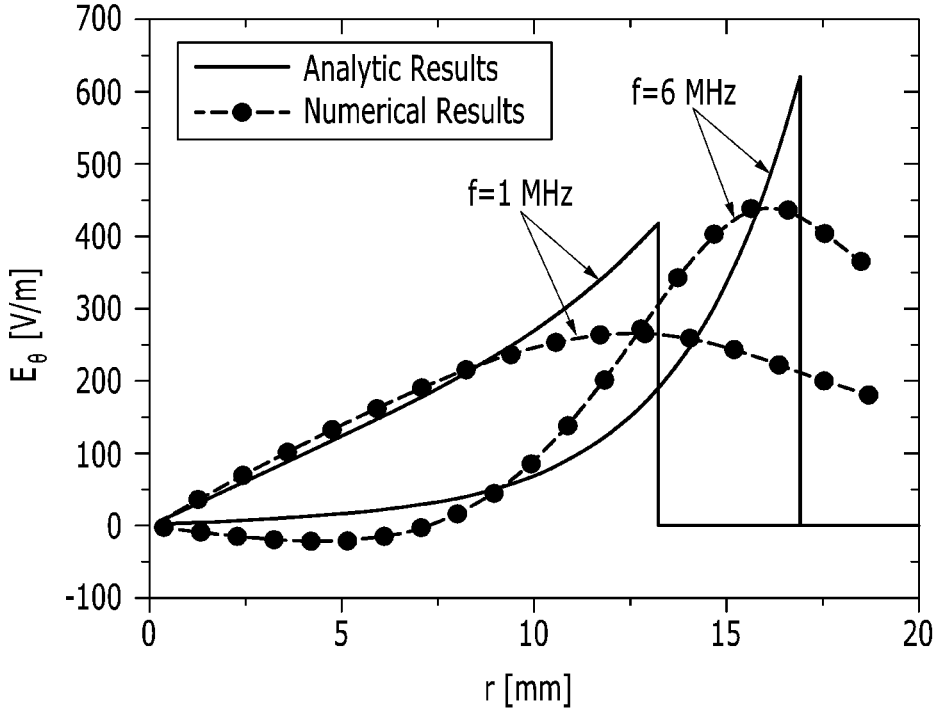
FIG. 3 illustrates a graph of an electric field according to positions in a confinement tube.

| | |
|---|---|
| 101: power supply | 106, 206: injection probe |
| 105, 205: induction coil | 108, 208: confinement tube |
| 300, 400, 500: power source | 301, 302, 401, 402, 501: inverter |
| 501: switch | |

MODE FOR INVENTION

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "indirectly coupled" to the other element through a third element. In addition, unless explicitly described to the contrary, the word "comprise" and variations such as "comprises" or "comprising" will be understood to imply the inclusion of stated elements but not the exclusion of any other elements.

Figure 4:
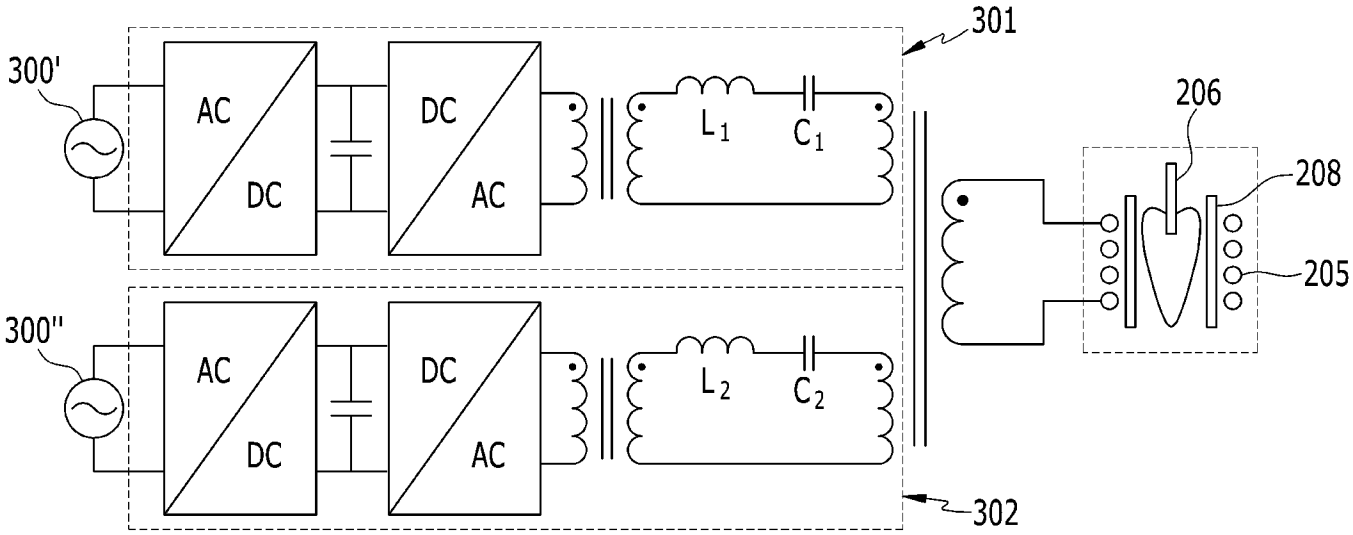
FIG. 4 illustrates a schematic view of an inductively coupled plasma torch according to a first exemplary embodiment of the present invention.
Figure 5:
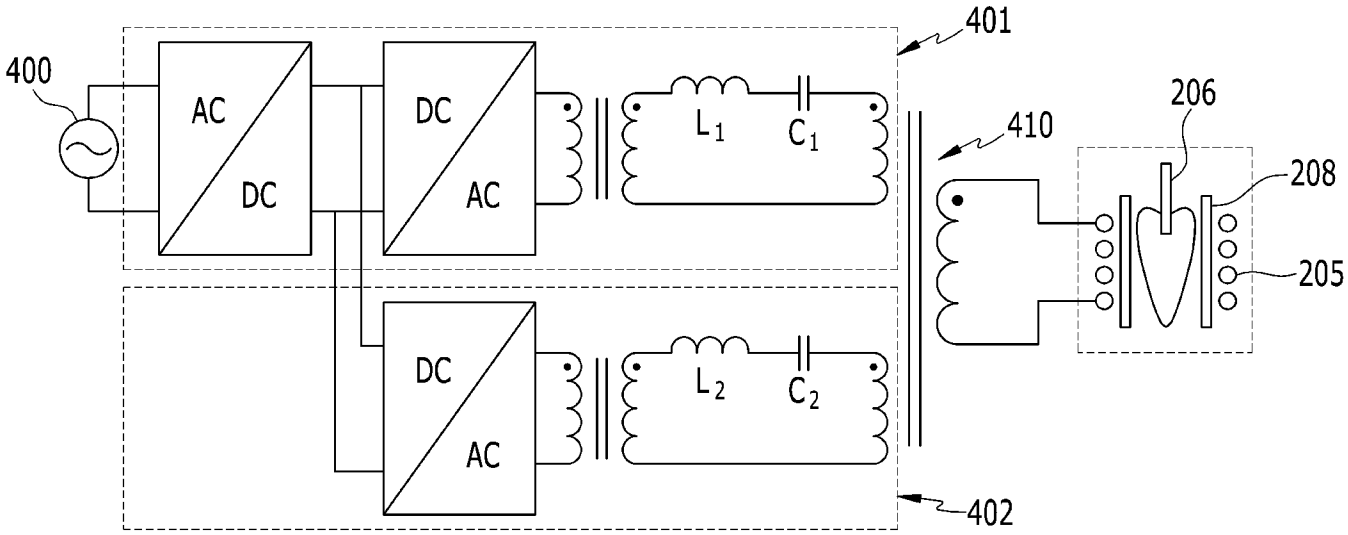
FIG. 5 illustrates a schematic view of an inductively coupled plasma torch according to a second exemplary embodiment of the present invention.
Figure 7:
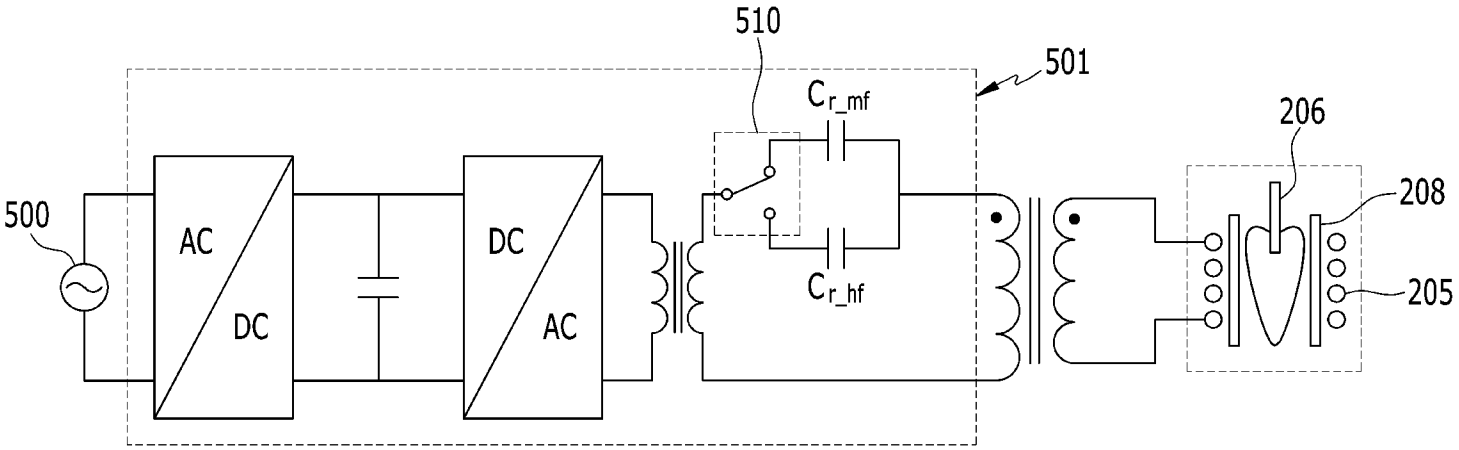
FIG. 7 illustrates a schematic view of an inductively coupled plasma torch according to a third exemplary embodiment of the present invention.

FIGS. 4, 5, and 7 illustrate exemplary embodiments of a dual frequency power-driven inductively coupled plasma torch according to an exemplary embodiment of the present invention, and since configurations of a confinement tube 208, an induction coil 205 surrounding the confinement tube 208, and an injection probe 206 are the same as or similar to those of the conventional inductively coupled plasma torch, a detailed description thereof will be omitted.

However, unlike the conventional power supply 101, a driving power supply according to an exemplary embodiment of the present invention may supply at least two powers having different frequencies at the same time (which may be referred to as simultaneous dual frequency (SDF)), or alternately supply at least two powers having different frequencies at predetermined intervals (which may be referred to as time sharing dual frequency (TSDF)). That is, it may be operated so as to stop power of a relatively low frequency when power of a relatively high frequency is inputted, while it may be operated so as to stop power of a relatively high frequency when power of a relatively low frequency is inputted.

Hereinafter, for better understanding and ease of description, power having a relatively high frequency of at least two powers having different frequencies will be referred to as "high-frequency power", and power having a relatively low frequency thereof will be referred to as "low-frequency power".

Figure 6:
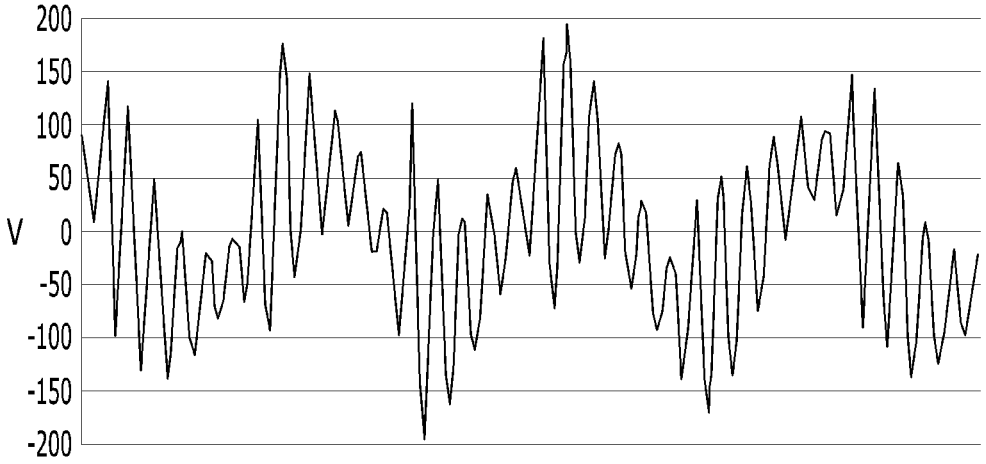
FIG. 6 illustrates an example of a simultaneous dual frequency (SDF) power waveform.

FIG. 4 illustrates a first exemplary embodiment that supplies SDF power to an inductively coupled plasma torch through two separate power sources 300' and 300" and dual inverters 301 and 302. Each of output terminals of the inverter 301 generating low-frequency power and the inverter 302 generating high-frequency power forms a primary side of a current transformer 410, and the induction coil of the inductively coupled plasma torch is connected to a secondary side of the current transformer, such that the high-frequency power and the low-frequency power may be simultaneously supplied to the induction coil 205. The power supplied from the two power sources 300' and 300" may be adjusted in consideration of temperature distribution, volume, etc. of the thermal plasma. Simultaneous dual frequency (hereinafter referred to as "SDF") corresponds to a combination of high-frequency power and low-frequency power, and as shown in FIG. 6, the high-frequency power and the low-frequency power are supplied to the induction coil of the inductively coupled plasma torch in a modulated form.

FIG. 5 illustrates a second exemplary embodiment that supplies the SDF power to the inductively coupled plasma torch in a similar fashion to the first exemplary embodiment, however unlike the first exemplary embodiment, after power is supplied from one power source 400 to inverters 401 and 402, the power is inverted into high-frequency power and low-frequency power through the inverters 401 and 402, respectively, which are then modulated to be supplied to the inductively coupled plasma torch.

Figure 8:
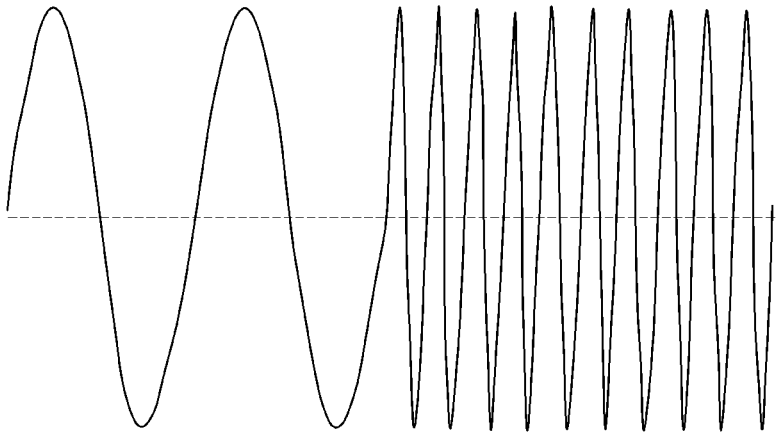
FIG. 8 illustrates an example of a time sharing dual frequency (TSDF) power waveform.

FIG. 7 illustrates a third exemplary embodiment related to the time sharing dual frequency power, wherein a power source 500 is connected to one inverter 501 and is controlled by a switch 510 in the inverter 501 so that high-frequency power and low-frequency power may be time-shared (or time-divided) and supplied. Unlike the first or second exemplary embodiment, in the third exemplary embodiment, the high-frequency power and the low-frequency power are not supplied as SDF power but are alternately supplied in a time-sharing manner. That is, as in a power waveform shown in FIG. 8, when the high-frequency power is supplied, the low-frequency power is not supplied, and when the low-frequency power is supplied, the high-frequency power is not supplied.

Although the method of supplying the power to the inductively coupled plasma torch according to the first to third exemplary embodiments has been described, since the specific SDF power supply/time sharing power supply method or topology may be selected by an ordinary technician as necessary, the present invention is not limited to the topologies of the SDF power supply method and the time sharing power supply method described above.

The frequency of the low-frequency power among the dual frequency powers, when an inner diameter of the confinement tube is given, may be determined through Equation 1, and when the inner diameter thereof is 100 mm or more, the frequency may be selected between 0.1-0.5 MHz. In this case, a frequency of the high-frequency power may be selected between 1-20 MHz. That is, the frequency of the low-frequency power may be determined by the inner diameter of the confinement tube, and the frequency of the high-frequency power may be selected so that thermal plasma may be formed between an inner circumferential surface of the confinement tube and a central portion of the confinement tube. In addition, the inductively coupled plasma torch may further include a water-cooled injection probe 206, which serves to inject materials to be processed into the plasma, and in this case, a low frequency and an inner diameter of the torch may be appropriately selected within a range in which an electromagnetic field by the low-frequency power does not interact with the injection probe 206.

Generally, in a case of a large-output torch with a torch input power of 100 kW or more, the inner diameter of the confinement tube thereof should be 100 mm or more to prevent damage to the confinement tube due to excessive heat. However, when a high frequency of 1 MHz or more is used in a torch requiring that the inner diameter is 100 mm or more and the torch input power is 100 kW or more, an off-axis characteristic of radial temperature distribution in the torch is more apparent as the torch input power increases, which reduces efficiency of heat utilization in a central axis region through which most of the materials to be processed pass and increases heat loss of the confinement tube. On the other hand, when a low frequency of 0.5 MHz or less is used in a large-output and high-frequency inductively coupled plasma torch of 100 kW or more, an electric field at a central axis thereof increases, thus it is difficult to insert a metallic water-cooled injection probe 206, and a taper phenomenon due to reduction of a diameter of the plasma becomes severe.

When the dual frequency power driving method according to the exemplary embodiment of the present invention is applied to the large-output torch of 100 kW or more having the above-mentioned problem, the plasma near the central axis thereof may be directly heated by the low-frequency power of 0.5 MHz or less to be maintained at a high temperature, and an outside portion of the plasma may be relatively heated by the high-frequency power of 1 MHz or more. Thus, the temperature and the electromagnetic field distribution within the plasma may be controlled to be fit for a purpose, such as stabilizing the entire plasma flame while reducing the off-axis temperature distribution characteristic. Particularly, in the high frequency power technology, a high efficiency semiconductor power device technology having power conversion efficiency of 95% or more is restrictively applied to a low output power supply of about 30 kW at a high frequency of 1 MHz or more, while it is commercially applied to a large-output power supply of 100 kW or more at a frequency of 0-0.5 MHz, thus when the mentioned two types of power supplies are combined and used, they may generate high-frequency inductively coupled plasma of 100 kW or more without using a conventional low-efficiency (50-60%) vacuum tube type of high-frequency power supply.

For reference, the present invention is suitable for a large plasma torch in which an inner diameter of the confinement tube is 80 mm or more and an output thereof is 50 kW or more, and more preferably, the present invention is suitable for a large plasma torch in which an inner diameter of the confinement tube is 200 mm or less and an output thereof is 400 kW or less. For example, a torch having an inner diameter of 100 mm and an output of 100 kW typically consumes about 300 slpm of gas, but when the inner diameter of the confinement tube thereof exceeds 200 mm, since at least four times as much gas must be supplied in order to obtain the same plasma speed, as the inner diameter increases, the gas consumption exponentially increases, thereby deteriorating economic efficiency. As compared with the torch having the inner diameter of 100 mm and the output of 100 kW, when a torch having a diameter of 200 mm or less is used, it is desirable to maintain plasma output to be 400 kW or less in order to maintain heat-flowing and torch efficiency in the torch.

Hereinafter, an effect according to the first embodiment of the present invention will be described through computer simulation. Specifically, performance of a 100 kW class high frequency inductively coupled plasma torch (of which inner diameter is 100 mm) driven at a 4 MHz single frequency and performance of a 100 kW class dual frequency power-driven high frequency inductively coupled plasma torch (of which inner diameter is 100 mm) driven at 0.5 MHz and 30 kW and 4 MHz and 70 kW are compared.

Table 1 below represents conditions of computer simulation performed for the present exemplary embodiment, except for the above-mentioned frequencies and output conditions. Results of the present exemplary embodiment were obtained by computer-numerical-analyzing electromagnetic fluid equations (a continuous equation, a momentum equation, an energy equation, and a vector potential equation), which are well known for behavioral description methods such as a temperature field and a velocity field in the high-frequency inductively coupled plasma, according to the conditions of Table 1.

TABLE 1

| Item | Condition |
|---|---|
| Design condition | |
| (1) Torch radius | 50 mm |
| (2) Radius of induction coil | 60 mm |
| (3) Winding number of induction coil | 4 |
| (4) Torch length | 160 mm |
| Driving condition | |
| (1) Central gas | 100 slpm |
| (2) Carrier gas | 0 |
| (3) Sheath gas | 200 slpm |
| (4) Gas type | Mixture of 70% Ar and 30% $H_2$ |

Test conditions for computational analysis of electromagnetic fluid equations

Figure 9:
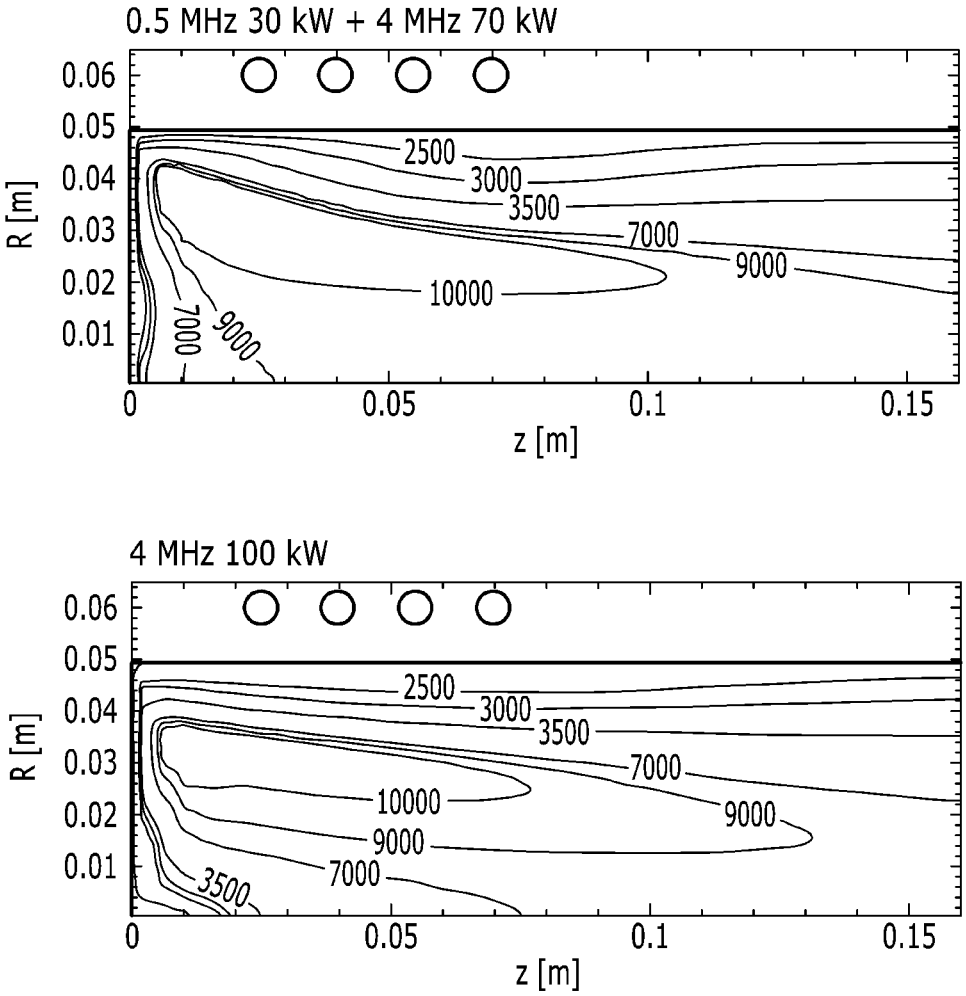
FIG. 9 illustrates temperature distribution in a confinement tube when the same power is supplied to each of induction coils in a form of dual frequency power and when it is supplied to each of the induction coils in a form of single frequency power.

FIG. 9 illustrates graphs in which temperature field distributions expected to be formed inside a torch having an inner diameter of 100 mm are obtained and compared by computer simulation when driven at a 4 MHz single frequency and when driven at a ratio of 3:7 of 0.5 MHz and 4 MHz frequencies, respectively. In this case, total energy supplied to the plasma torch driven at the single frequency and total energy supplied to the plasma torch driven at the dual frequencies were set to be the same.

As can be seen from the temperature distribution shown in FIG. 9, when the torch is driven by the dual frequency power, a high temperature region of 7000 K or more is maintained even in the vicinity of the central axis of the torch. In contrast, when the torch is driven by the single frequency power, the off-axis temperature distribution, which is a typical characteristic of the conventional high-frequency inductively coupled plasma torch, such as falling below 5000 K in the vicinity of the central axis of the torch, is formed. That is, it can be seen from FIG. 9 that in the case of the dual frequency power-driven method in which the low-frequency power and the high-frequency power are simultaneously supplied, it is possible to control a non-uniformity problem of the conventional high-frequency single-driven method.

Figure 10:
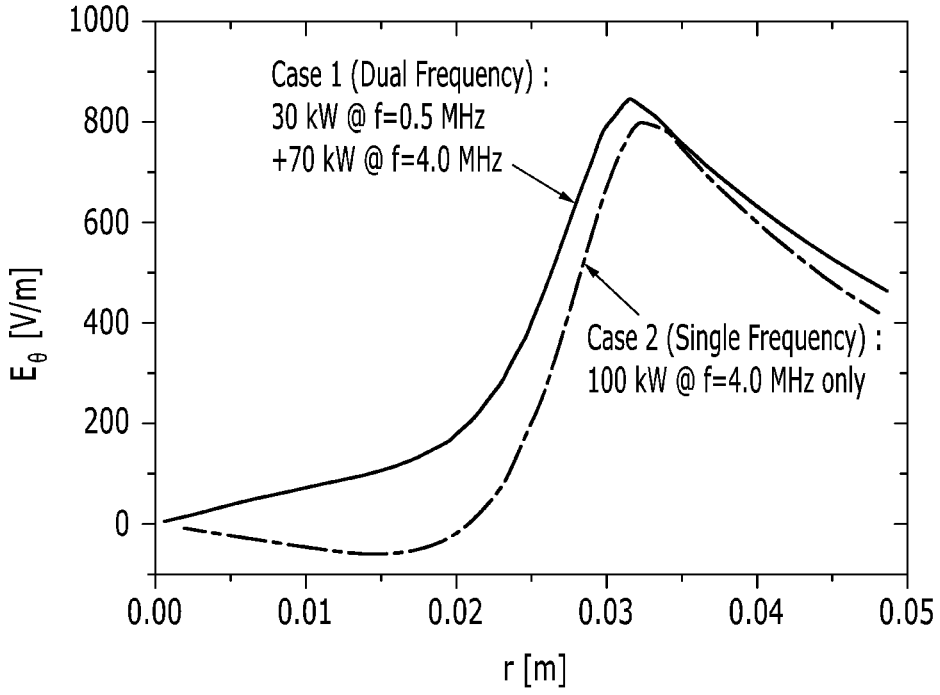
FIG. 10 illustrates an electric field with respect to each position in a confinement tube when the same power is supplied to each of induction coils in a form of dual frequency power and when it is supplied to each of the induction coils in a form of single frequency power.

FIG. 10 illustrates electric field distribution calculated in a radial direction at 0.05 m in a longitudinal direction of two types of torches. In the case of the dual frequency power-driven method, the relative high temperature region observed near the central axis is due to the Joule heat heating by the 0.5 MHz low-frequency power-driven electric field that exists from the penetration depth of the high-frequency electric field of 4 MHz to the vicinity of the center axis. As described above, when the torch is driven with different outputs for each frequency, the dual frequency power-driven method may control the internal temperature distribution and the electromagnetic field distribution of the torch in accordance with the application purpose.

According to the simulation described above, even though the same power is supplied, when it is converted into two powers having different frequencies and supplied, it can be seen that excellent effects may be obtained in both the highest temperature and the temperature distribution of the thermal plasma compared to the case of supplying the single frequency power.

While this invention has been described in connection with what is presently considered to be practical exemplary embodiments, it is to be understood that the invention is not limited to the disclosed embodiments, but those skilled in the art may suggest another exemplary embodiment by adding, modifying, or deleting components within the spirit and scope of the appended claims, and the other exemplary embodiment also falls in the scope of the present invention.

The invention claimed is:

1. A dual frequency power-driven inductively coupled plasma torch, comprising:

a hollow confinement tube provided with a space in which thermal plasma is formed;

an induction coil that surrounds the confinement tube; and a power supply source that supplies power to the induction coil, wherein the power supply source supplies at least two powers having different frequencies to the induction coil, wherein the at least two powers includes a first power having a first frequency and a second power having a second frequency higher than the first frequency, and wherein the first power and the second power are supplied to the induction coil in a simultaneous dual frequency (SDF) manner where the first frequency and the second frequency are combined in a modulated form.

2. The dual frequency power-driven inductively coupled plasma torch of claim 1, wherein the at least two powers having different frequencies are implemented by two separate power sources and two inverters.

3. The dual frequency power-driven inductively coupled plasma torch of claim 1, wherein the at least two powers having different frequencies are implemented by one power source and two inverters connected in parallel to the one power source.

4. A dual frequency power-driven inductively coupled plasma torch, comprising:

a hollow confinement tube provided with a space in which thermal plasma is formed;

an induction coil that surrounds the confinement tube; and a power supply source that supplies power to the induction coil, wherein the power supply source supplies at least two powers having different frequencies to the induction coil, wherein the at least two powers having different frequencies are time sharing dual frequency powers that are time-shared and alternately supplied to the induction coil.

5. The dual frequency power-driven inductively coupled plasma torch of claim 1, wherein a low-frequency power of the at least two powers having different frequencies has a frequency of 0.05-0.5 MHz, and a high-frequency power thereof has a frequency of 1-20 MHz.

6. The dual frequency power-driven inductively coupled plasma torch of claim 1, further comprising an injection probe that introduces nano-metal particle precursors into the confinement tube.

7. An apparatus for generating nanoparticles, comprising:

a device that supplies nanoparticle precursors; and the dual frequency power-driven inductively coupled plasma torch of claim 1, wherein the dual frequency power-driven inductively coupled plasma torch receives and evaporates the nanoparticle precursors from the device to form nanoparticles.

8. The apparatus for generating the nanoparticles of claim 7, wherein the nanoparticle precursors are introduced into the confinement tube from the device through an injection probe.

9. The apparatus for generating the nanoparticles of claim 7, wherein the nanoparticle precursors are one or more materials selected from a metal, a metal oxide, and a ceramic.

10. The dual frequency power-driven inductively coupled plasma torch of claim 4, wherein a low-frequency power of the at least two powers having different frequencies has a frequency of 0.05-0.5 MHz, and a high-frequency power thereof has a frequency of 1-20 MHz.

11. The dual frequency power-driven inductively coupled plasma torch of claim 4, further comprising an injection probe that introduces nano-metal particle precursors into the confinement tube.

12. An apparatus for generating nanoparticles, comprising:

a device that supplies nanoparticle precursors; and the dual frequency power-driven inductively coupled plasma torch of claim 4, wherein the dual frequency power-driven inductively coupled plasma torch receives and evaporates the nanoparticle precursors from the device to form nanoparticles.

13. The apparatus for generating the nanoparticles of claim 12, wherein the nanoparticle precursors are introduced into the confinement tube from the device through an injection probe.

14. The apparatus for generating the nanoparticles of claim 12, wherein the nanoparticle precursors are one or more materials selected from a metal, a metal oxide, and a ceramic.

* * * * *